US005505009A

United States Patent [19]

Stein et al.

[11] Patent Number: 5,505,009

[45] Date of Patent: Apr. 9, 1996

[54] HEATED PRODUCT MERCHANDISER

[75] Inventors: Andrew M. Stein, Massapequa Park; Andrew Jinks, Amityville, both of N.Y.

[73] Assignee: Six Corners Development Company, Amityville, N.Y.

[21] Appl. No.: 328,243

[22] Filed: Oct. 24, 1994

[51] Int. Cl.[6] ..... F26B 21/06

[52] U.S. Cl. ..... 34/543; 34/549; 34/88; 34/211; 99/476; 99/483; 99/468

[58] Field of Search ..... 34/88, 196, 197, 34/209, 211, 212, 215, 543, 546, 549, 553; 99/468, 476, 483

[56] References Cited

U.S. PATENT DOCUMENTS

| | | | |
|---|---|---|---|
| 1,350,112 | 8/1920 | Payne | 34/88 |
| 2,172,059 | 9/1939 | Chilton | 34/196 |
| 2,458,190 | 1/1949 | Newburger | 34/211 |
| 2,529,877 | 11/1950 | Ladge | 34/88 |
| 2,557,605 | 6/1951 | Kohut | 34/196 |
| 4,623,780 | 11/1986 | Shelton | 99/468 |
| 4,803,921 | 2/1989 | Nuss | 34/88 |
| 4,850,120 | 7/1989 | Stein | 34/88 |

*Primary Examiner*—F. Daniel Lopez
*Attorney, Agent, or Firm*—Pennie & Edmonds

[57] ABSTRACT

The present invention relates to a food storage, display, and warming apparatus having a first storage compartment for holding bulk food at a predetermined temperature above ambient temperature and including one or more door members for accessing the bulk food therein, a second storage and display compartment for holding and displaying a plurality of individualized food portions and including one or more transparent door members for viewing and accessing the individualized food portions therein, a heater and blower arrangement for circulating heated air between the first and second storage compartments, a thermostat for sensing the temperature in the first storage compartment and for discontinuing operation of the heater when a maximum temperature is sensed to avoid overheating the bulk food.

20 Claims, 7 Drawing Sheets

HEATED PRODUCT MERCHANDISER

FIELD OF THE INVENTION

The present invention relates to an improved apparatus for storing and warming bulk food such as popcorn, as well as displaying a plurality of serving portions of such food at a predetermined temperature.

BACKGROUND ART

Various devices have been proposed for keeping food, such as popcorn, warm prior to serving to a customer. One such recent apparatus is identified in U.S. Pat. No. 5,123,178, which is incorporated herein by reference in its entirety. This type of merchandiser operates by heating air, which is then circulated and recirculated around individual portions of food.

Another prior art example of a heated product merchandiser is disclosed in U.S. Pat. No. 4,850,120 ("the 120 patent"), which is incorporated herein by reference in its entirety. The device disclosed in the '120 patent has two interconnected compartments for food, a bulk storage compartment for heating, storing and displaying food in bulk, and a storage and display compartment for heating, storing, and displaying food in individual portions.

Many disadvantages to these prior art product merchandisers and food warmers have been identified. One prior art model has a thermostat at the top of the chimney that senses the temperature of the air when it reaches the top of the merchandiser. This thermostat can only sense the temperature if there is sufficient air flow, however. If heated air flow is restricted, an extended period of time may pass before thermostat at the top of the merchandiser switches the heater off. During this time period, the food at the bottom of the merchandiser may be overheated and scorched.

Another drawback is the need for an attendant to serve food. Prior art devices were designed to be attended at all times since the doors of the units faced the server. Typically, a user approaches one side of the cabinet and asks the attendant on the other side for a portion package of food. The attendant opens the doors facing her, removes a portion package, and hands it to the customer. While this may be appropriate for many food service situations, it is not appropriate for those which require the relatively fast distribution of foods to multiple customers during very busy periods.

The prior art merchandisers were also limited in that they could not be integrated easily into a food service line. Typically, a food service line has a shelf or counter facing the customer that allows the customer to select his own food at each station. As each customer slides his tray along the line from station to station, he selects individual portion packages to place on his tray.

Yet another drawback is the limited space provided for attendants to the apparatus. A merchandiser with a single bulk food compartment door provides space for only a single attendant at a time. When an attendant bends over to scoop up food into individual portion packages, there is little space for an additional attendant to also fill portion packages with food or room to fill the bulk food compartment.

Other problems with prior art devices include the unnecessary time required to clean the machine as each portion package is removed. As each portion package is removed there is inevitably some spillage. This spillage gathers on each of the shelves of the portion compartment and must be swept out. Unfortunately, sweeping requires that the portion packages be removed from the upper unit and placed in a different location (typically room temperature) while the shelves are cleaned. Meanwhile, the food cools off and is unpalatable to the customer.

Some foods like popcorn may fragment into small particles that are not saleable. This typically happens in the bulk food compartment where the food is scooped into portion packages. In the prior art merchandisers there is no way of separating these small particles from the saleable food without emptying the lower bin and somehow sifting the bulk food—an awkward process at best.

Accordingly, the present invention provides simple solutions to these problems in a heretofore unknown manner, so as to improve the efficiency of serving bulk foods and to improve the food's palatability.

SUMMARY OF THE INVENTION

The present invention relates to a food storage, display, and warming apparatus comprising a first storage compartment which includes a base for holding bulk food at a predetermined temperature above ambient temperature and including means for accessing the bulk food therein, a second storage and display compartment for holding and displaying a plurality of individualized food portions and including means for viewing and accessing the individualized food portions therein, means for heating and circulating air between the first and second storage compartments, means for sensing the temperature of the base of the first storage compartment and for discontinuing operation of the heating means when a maximum temperature is sensed to avoid overheating the bulk food.

The heating and recirculating means comprises an electric heating element, a blower for urging the air past the heating element and at least one conduit for returning heated air from the top of the second compartment to the heating element. The apparatus includes a third compartment located below the first compartment for housing the heating and circulating means, such that the at least one conduit extends from the top of the second compartment to the heating element in the third compartment. The apparatus may include a partition member for supporting both the blower and heating element, with the partition being removable from the third compartment for ease in maintaining or repairing the blower or heating element.

The partition member includes a front panel which forms a portion of the exterior of the third compartment, and a first insulating member positioned between the heating element and the front panel to reduce or prevent heating of the front panel. Advantageously, the blower and heating element are mounted on opposite sides of the partition member and first the insulating member comprises a non-conductive or thermally insulative material.

The temperature sensing means and heating element are electrically connected by a cable, and the sensing means is preferably a thermostat which is mounted in the third compartment. The cable is of sufficient length to allow the partition to be slideably removed from the third compartment for maintenance or repair thereof without disconnecting the thermostat. A common wall member is provided between the first and third compartments, the wall member being made of a heat conductive metal. Thus, the thermostat can be placed in contact and in thermal association with the wall member.

The third compartment preferably includes a slidable drawer, and the wall member includes a perforated section positioned above the drawer for allowing heated air to pass from the third compartment to the first compartment and for removing unwanted food portions or debris from the first compartment. When the partition member includes a front panel which forms a portion of the exterior of the third compartment, a second insulating member comprising a nonconductive or thermally insulative material is positioned between the heating element and the drawer to reduce or prevent heating of the drawer.

The apparatus advantageously provides a separation member between the first and second compartments and having means for allowing heated air to travel from the first compartment to the second compartment while also allowing food spilled from the individualized portions to return through the wall member to the first compartment. The compartment has a front wall, a rear wall and two side walls, a plurality of shelves for supporting the individualized food portions, and an elongated U-shaped bracket members mounted upon the side walls for engaging the sides and a portion of the top and bottom surfaces of the shelves. These brackets facilitate sliding horizontal movement of the shelves but which restricts tilting or vertical movement of the shelves. The shelves are made of wire having openings which allow food spilled from the individualized portions to fall to the bottom of the second compartment. Also, the first and second compartments can be separately accessed so that escape of heated air from the compartments can be minimized.

The means for viewing and accessing the individualized food portions in the second compartment advantageously includes at least one door member in the front wall of the second compartment and at least one transparent door member in the front wall of the second compartment so that the individual food portions can be accessed from either the front or rear of the apparatus. Similarly, the first compartment includes front and rear walls and the means for accessing the bulk food in the first compartment includes at least one door member in the front wall and at least one door member in the rear wall so that the bulk food can be accessed from either the front or rear of the apparatus. In this regard, the front and rear walls of the first compartment may be sloped and provided with two doors to facilitate access to the bulk food therein.

The first compartment may further comprise a shelf member mounted on one of the front or rear walls of the first compartment. This shelf may be hingeably mounted to the first position at a location above the means for accessing the first compartment.

The electrical components include a shut off switch and a grounded enclosure for protecting operators from electrical shock when operating the electronic components. The sensing device is preferably a thermostat.

BRIEF DESCRIPTION OF THE DRAWINGS

The preferred embodiments of the present invention may more fully understood by reviewing the attached detailed description and accompanying drawing figures wherein.

DETAILED DESCRIPTION OF THE INVENTION

Figure 1:
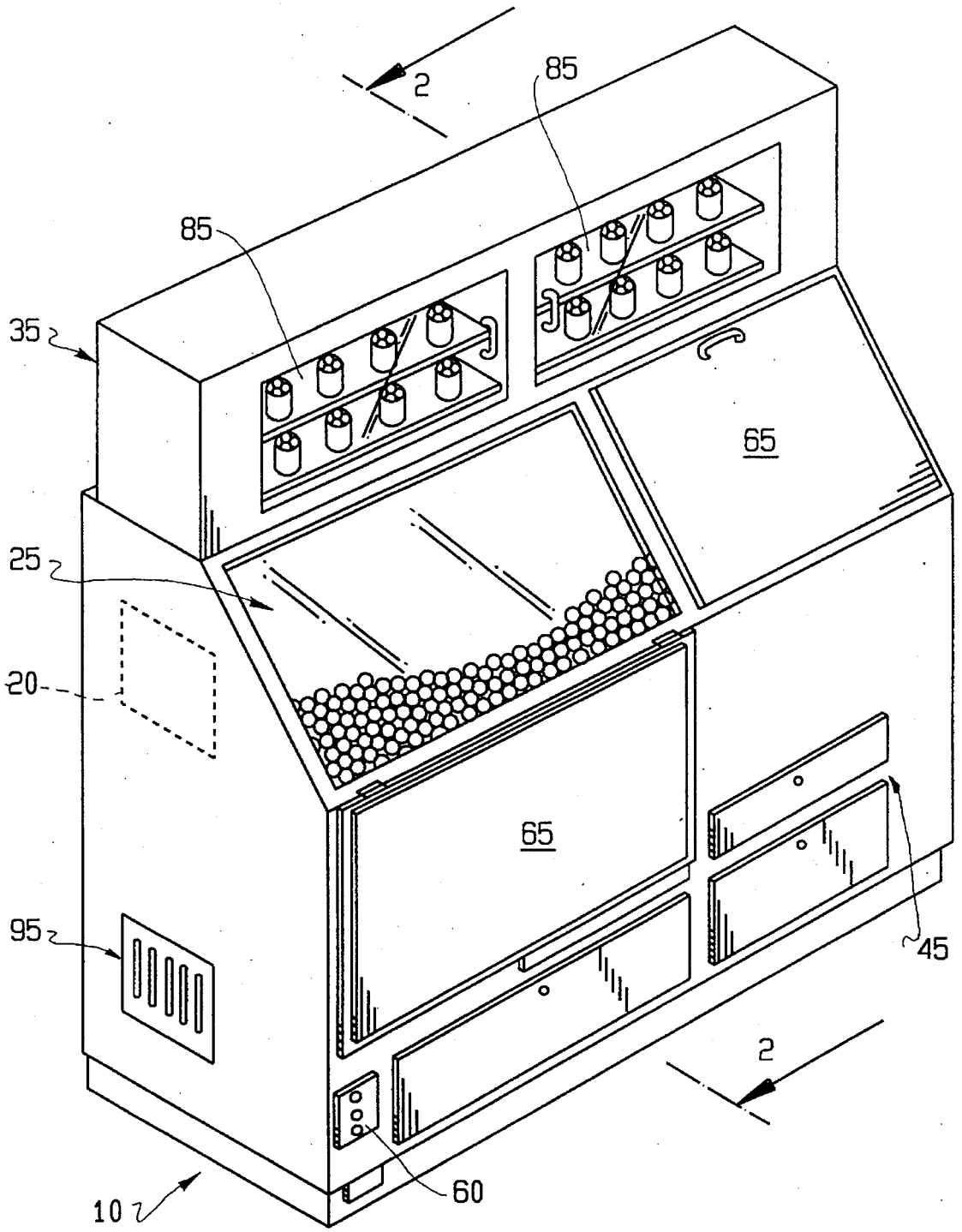
FIG. 1 Prior Art
FIG. 1 illustrates a conventional popcorn warmer.
Figure 2:
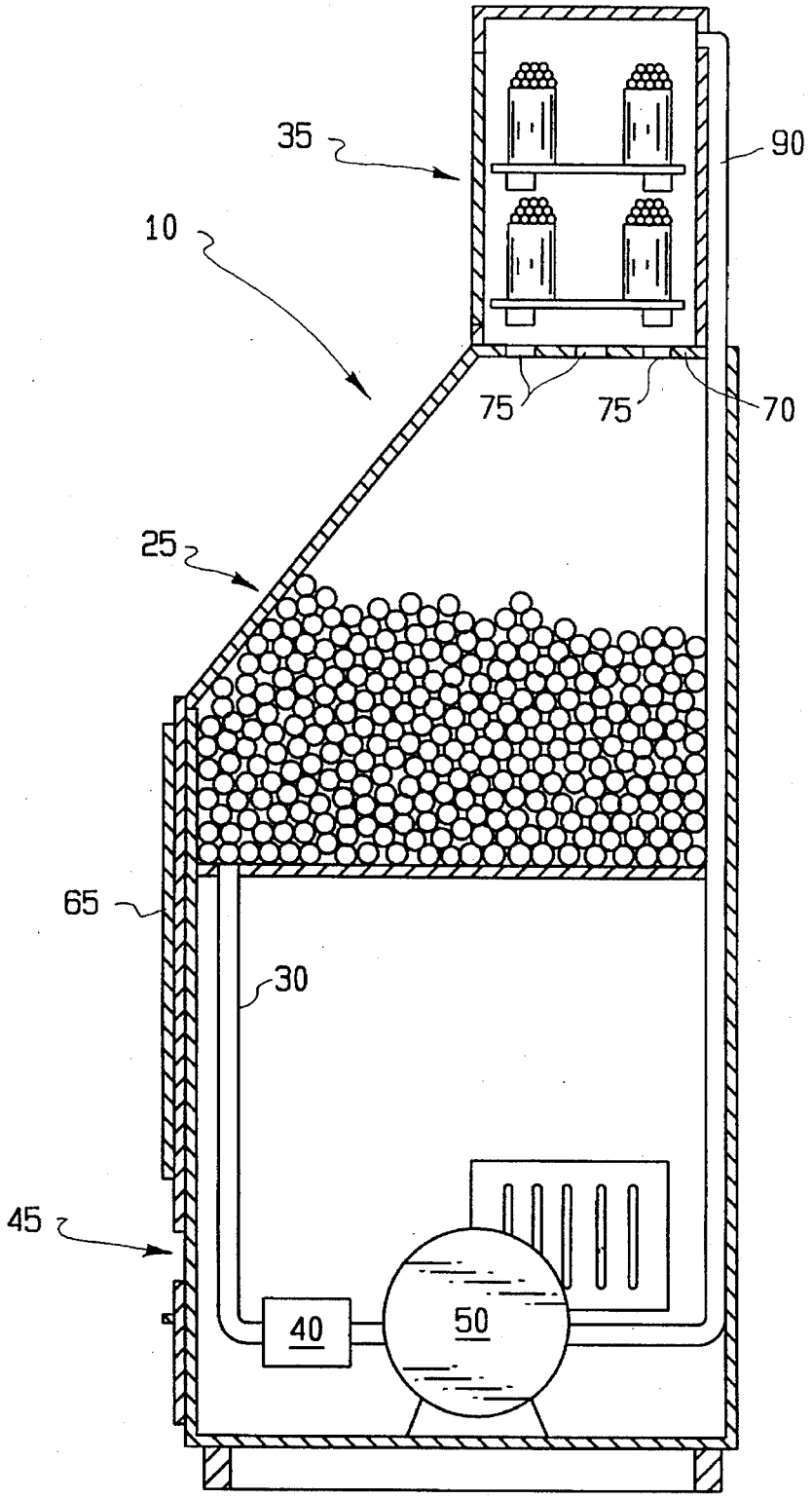
FIG. 2 Prior Art
FIG. 2 is a cross-sectional view of the conventional popcorn warmer of FIG. 1.

FIGS. 1 and 2 disclose conventional popcorn warmers. These figures correspond to FIGS. 1 and 4 of the '120 patent discussed above. Each device has three major compartments: a bulk food compartment 25 for holding food in bulk before it is placed in individual portion containers or boxes; an individualized serving portion compartment 35 for holding food after it has been placed in portion containers; and a utility storage compartment 45 for housing electrical components. Heated air is circulated throughout the food warmer to maintain the food at an optimum serving temperature as follows. Blower 50 directs air past electrically powered heater 40, through perforated cover plate 42 and thereafter through chamber 44 and the perforated section 46 of floor 48. The air then passes upward past the popcorn in compartment 25 and into the individualized serving portion compartment 35. Thereafter chimney 52 allows return of hot air to the blower 50. Prior art food warmers used a thermostat to regulate the temperature of the air in the food warmer, but it was located at or near the top of the chimney 52. In these devices, if the air became too hot at the thermostat, the thermostat would stop the heater until the air temperature dropped to an acceptable level. Generally, the thermostat was set to cut off the heater when it sensed a temperature of between about 130° and 150° F. and preferably 140° F.

Figure 3:
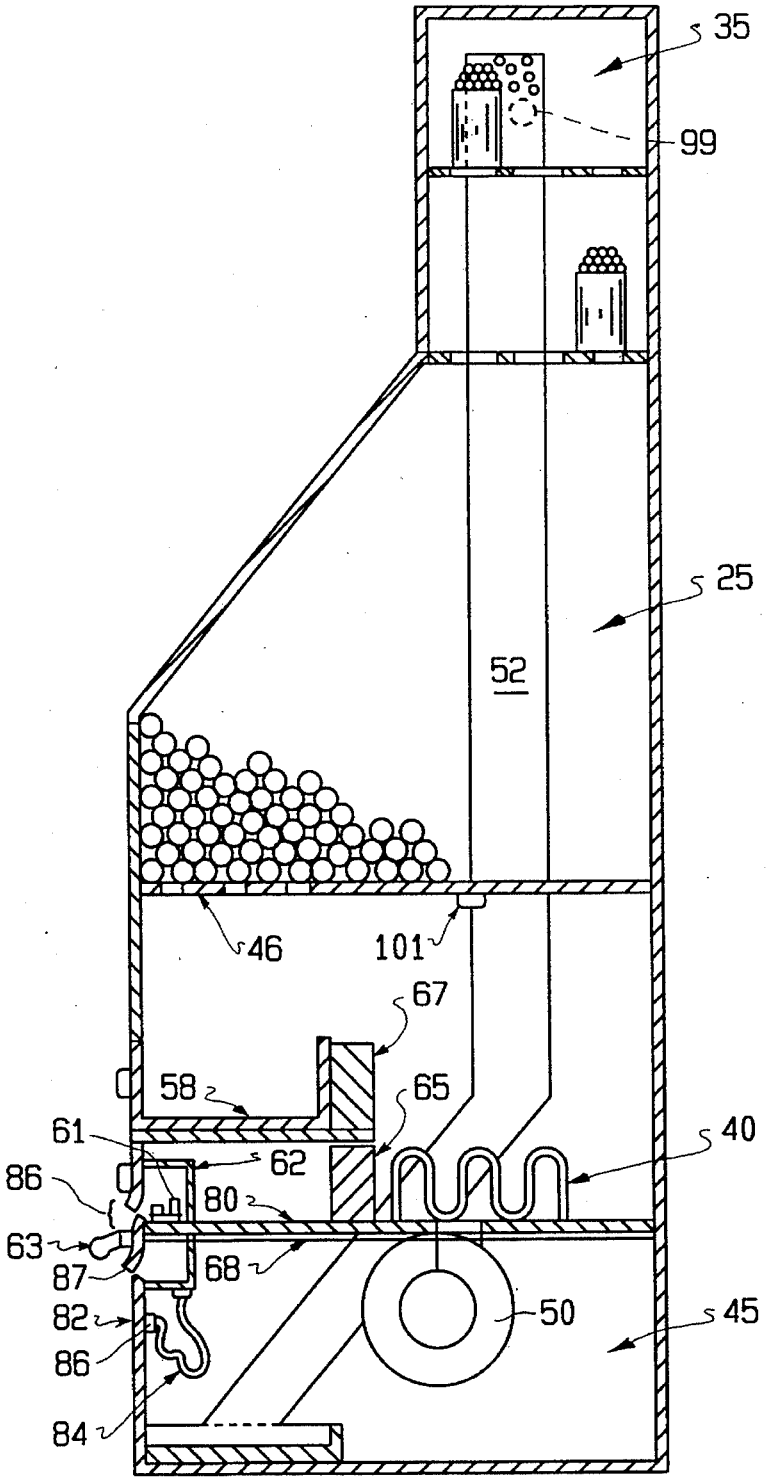
FIG. 3 is a cross-sectional view of a popcorn warmer according to the invention.

FIG. 3 illustrates a partial cross section of compartments 25 and 45 showing an improved temperature control system in accordance with the present invention, among other new features. The prior art first thermostat 99 is shown here in the top of chimney 52. This is set to the same range as in the prior art. However, a second thermostat 101 is located in the airstream between electrically powered heater 40 and the perforated section of floor 46 of compartment 25. In a preferred embodiment, thermostat 101 is oriented directly above the heater. Advantageously, it is attached to floor 48 of compartment 25 and floor 48 is made of a heat conductive metal so that the thermostat can quickly and accurately determine the temperature in the bottom of the first compartment. This thermostat 101 is preferably set to stop the heater when a temperature of between 140° and 160° F., and more preferably, 150° F. is reached.

Also illustrated by FIG. 3 is a novel orientation of the perforated section 46 of floor 48. Unlike conventional embodiments (see FIG. 2), in which the perforations of floor section 46 extended across a substantial amount of floor 48, including over the heating element 40, an improved arrangement of perforations has been devised. In accordance with the present invention, perforated section 46 does not extend over heating element 40. In a preferred embodiment, perforated section 46 only extends over clean-out drawer 58. This allows the operator to remove unpopped corn or other small debris from the floor of the device directly into the clean-out drawer. In addition, heated air can pass through the perforations and into the bulk food storage compartment.

According to another preferred embodiment of the invention, the perforations no longer serve merely to pass heated air and remove unpopped corn, but also serve to sift the bulk food in compartment 25. Much of the bulk food heated and served using food warmers is subject to breakage before it is bagged. This is a particular problem where popcorn is concerned. Thus, the perforations of floor 46 may be sized accordingly to sift out unsalably sized particles. If the perforations are made too large, however, or are spaced to closely together, the bulk food in compartment 25 will tend to stick in the perforations and the perforations themselves will tend to break the bulk food apart. On the other hand, if the perforations of section 46 are made too small and are spaced too far apart, they will not easily sift out broken particles of food.

Although one of ordinary skill in the art can determine suitable areas and spacings to sift unsalable popcorn out of salable popcorn, the following have been determined to be optimal. For section 46, a perforation area of between about 5 $mm^2$ to 63 $mm^2$ is preferred, as is a perforation center-to center spacing of between 5 mm and 38 mm, the exact size and spacing depending on the type of popcorn used.

Alternatively, the perforated section 46 can be replaced with a wire grill. If a wire grill is used in place of a perforated sheet at the bottom of compartment 25, the preferred gap between the rods comprising the grill is between 3 mm and 16 mm. A gap in this range facilitates the flow of heated air as well as allows particularly effective sifting separation of salable popcorn kernels from unsalable popcorn particles, again, depending on the type of popcorn.

Referring again to FIG. 3, this preferred embodiment locates particular components in a manner that allows for easy maintenance and reduces the risk of fire and burns to the user. In particular, blower 50, heater 40, food warmer electronics 61, and thermally insulated barrier 65 are shown connected to partition 80 which itself is slideably mounted on support partition 68. Partition 80 and the electrical devices mounted upon it can be easily and slideably removed from the food warmer by pulling out front cover 82. By mounting these components on a slideably removable partition, maintenance and troubleshooting take much less time that in prior art food warmers. Rather than reaching inside the machine to check and repair parts, maintenance can be performed by sliding partition 80 out of the machine.

Extended electrical cables 84, that connect the various electrical components on partition 80 to other electrical components of the food warmer are lengthened to allow partition 80 and its attached components to be slid out of the food warmer while maintaining an electrical connection with the rest of the food warmer. Should a maintenance person desire to remove partition 80 and its attached components, cables 84 are equipped with plugs 86 that may be unplugged once partition 80 is partially or fully slid out of the food warmer.

Thermally insulated barrier 65 is oriented between heater 40 and food warmer electronics 61 to reduce the effect of the heater on electronics 61. Barrier 65 is preferably made a relatively non-conductive or thermally insulative material such as high temperature resistant polystyrene or a ceramic blanket, each placed in a suitable metal support, to block or prevent the transfer of heat from the heater to the front panel of the partition 80 which is on the exterior of the apparatus. Barrier 65 is preferably oriented between the front cover 82 and heater 40 to reduce the potential for user burns. A second thermally insulated barrier 67 of the same construction is oriented between heater 40 and clean-out drawer 58 to reduce the heating of drawer 58 and possible injury to users who must empty this drawer.

Food warmer electronics 61 are also shielded from the environment by electronics enclosure 62. This enclosure surrounds electronics 61, and is preferably metallic and grounded to protect the user and maintenance personnel. Power switch 63 is mounted in front panel 82 such that wiring between switch 63 and electronics 61 are shielded from the environment by electronics enclosure 62.

To reduce the buildup of heat inside the electronics enclosure, front cover 82 has vents 86 that allow ambient air to pass easily into and out of electronics enclosure 62. The orientation of these vents is preferably open on their lower edge 87 to reduce the risk that liquid spills down the front of the food warmer will enter the electronics enclosure 62.

Figure 4:
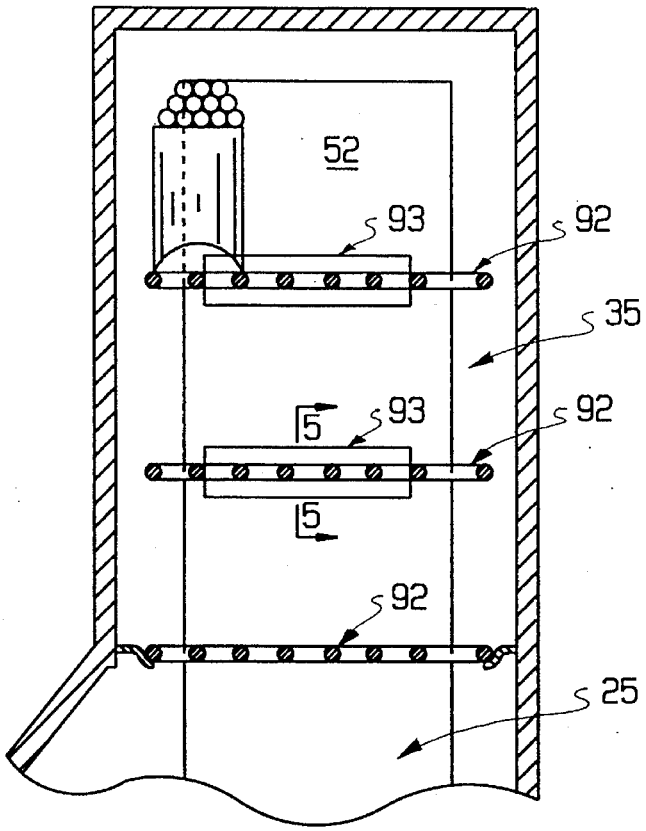
FIG. 4 is a cross-sectional view of the upper part of the popcorn warmer of FIG. 3.

FIG. 4 discloses a cross section of the upper part of compartments 25 and 35 according to the subject invention. Shelves 92 are installed in compartment 35 to support portion containers of heated food. As portion packages are filled with food they are placed on shelves 92, around which (or through which) heated air passes. According to the subject invention, shelves 92 allow spilled food particles to pass through, yet safely support the portion packages placed upon them. If the perforations are appropriately sized, food particles may pass downwards into the bulk storage compartment 25 when spilled from individual containers, thus allowing it to be reheated and made available for repackaging at another time. The preferred shelf material for this purpose is wire shelving with gaps of between 10 mm and 40 mm. This range of sizes will allow the majority of particles to pass into compartment 25 while properly supporting a range of standard portion containers.

Figure 5:
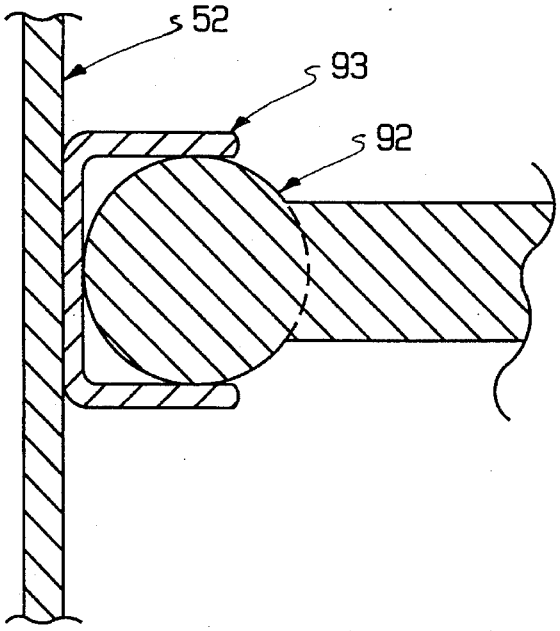
FIG. 5 is a cross-sectional view of a shelf and support bracket for the popcorn warmer of FIG. 3.

FIG. 5 is a cross sectional view taken along lines 5—5 of FIG. 4. Brackets 93 for supporting shelves 92 in the upper compartment are illustrated. These brackets prevent shelves 92 from moving in two directions—both upwards and downwards—preferably also allowing shelves 92 to be slid out for easy removal and cleaning. Unlike prior art brackets, which supported shelves 92 only from underneath, the added upward restraint provided by the C-shaped brackets 93 prevent shelves 92 from tipping upwards or downwards causing shelf collapse onto lower shelves or into bulk food compartment 25 with the resulting contamination of food.

Figure 6:
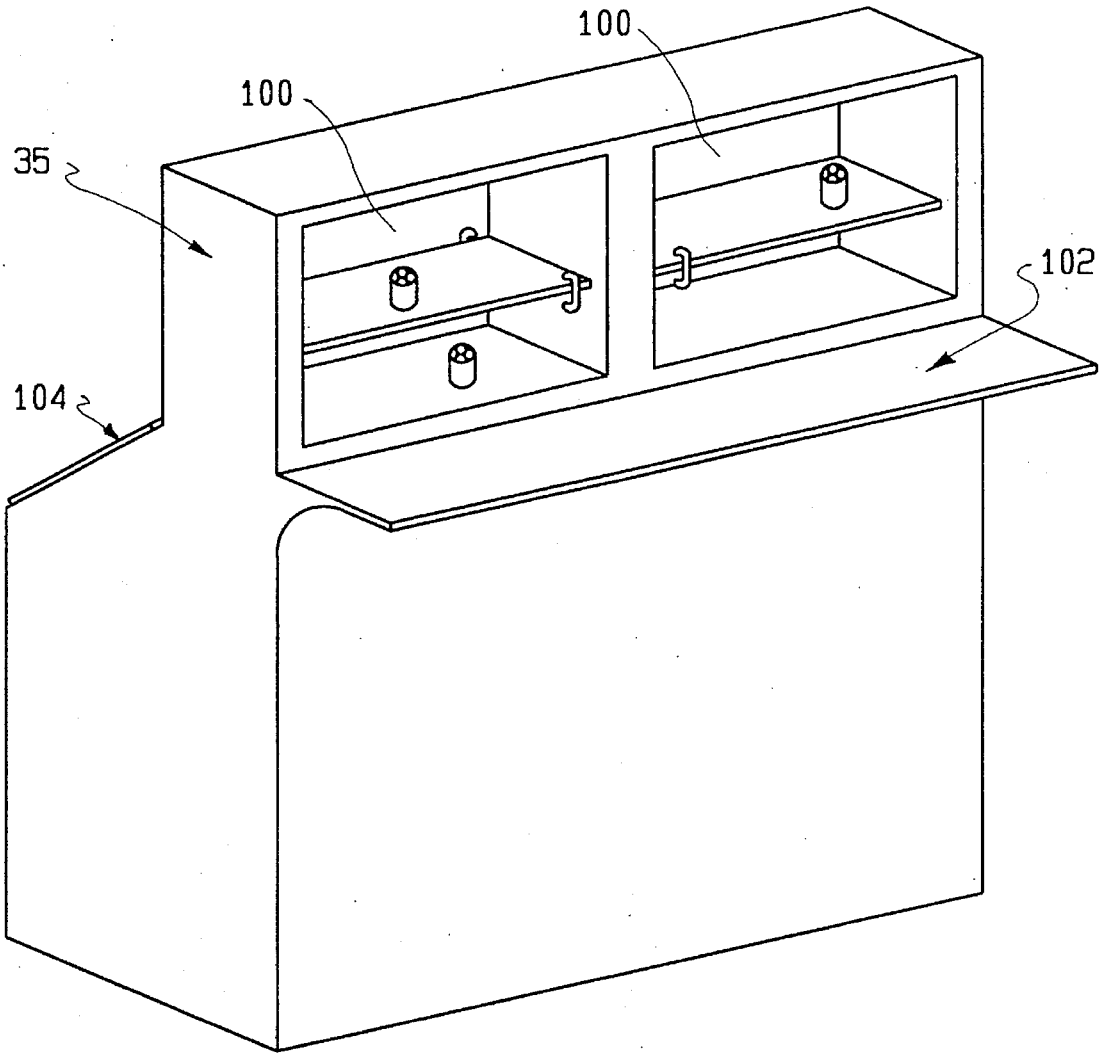
FIG. 6 illustrates another popcorn warmer having a plurality of upper doors and a fixed external shelf.

FIG. 6 discloses a food warmer having a second set of doors 100 to compartment 35 located on the opposite side of compartment 35 than doors 85, shown differently in FIG. 1. This added set of doors reduces the need for an attendant in many food service situations. The prior art food warmer seen in FIG. 1 required an attendant at all times. Customers were unable to serve themselves, thus making a food warmer attendant necessary. By allowing customers to have access to food from the warmer, they can serve themselves and labor can be reduced.

Also seen in FIG. 6 is a fixed food service shelf 102 extending horizontally below doors 100 approximately at the customer's waist level. This shelf allows customers to temporarily place any individualized food portions which are removed from the upper compartment. In addition, a tray or other items down can be placed upon the shelf 102 while the door is opened and individualized portions are retrieved. This is especially important in a self-service or cafeteria-style setting where a food service shelf typically runs along the entire food service line. The shelf may be adapted to fit into an existing food service line. In this embodiment, the shelf is on the opposite side of the food warmer than door 104 through which the attendant accesses the bulk food compartment 25. By this method, the food service establishment maintains control over bulk food, yet allows individuals to select portion packages.

Figure 7:
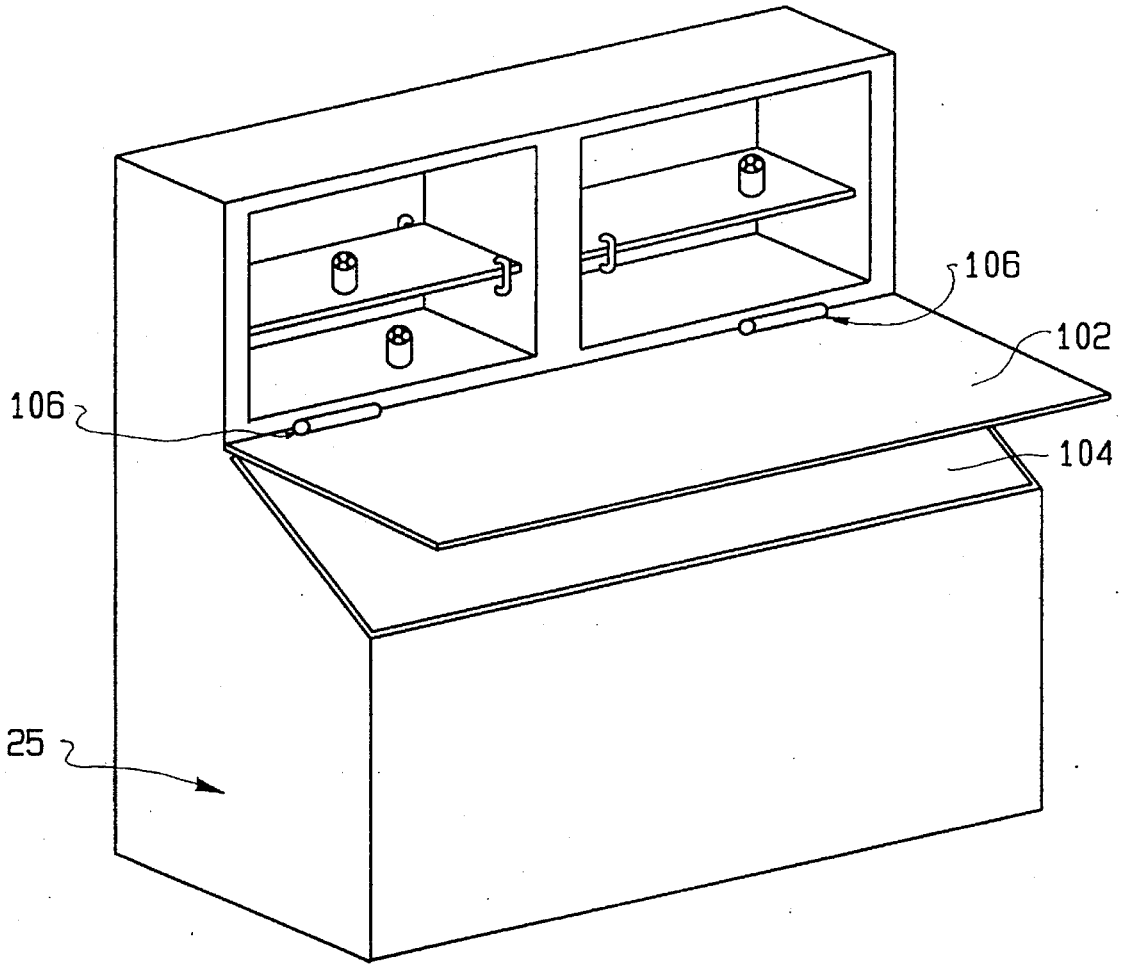
FIG. 7 illustrates another popcorn warmer having a hinged external shelf.

As an alternative to this embodiment, FIG. 7 discloses a shelf 102 located directly above door 104 in the bulk food compartment 25. Shelf 102 is preferably attached to the food warmer by hinges 106 that allow the shelf to be swung upwards and out of the way as the bulk food compartment is accessed and individual portion containers are filled. This configuration is particularly adapted to a self-service setting where access to both sides of the food warmer is not critical or essential.

Figure 8:
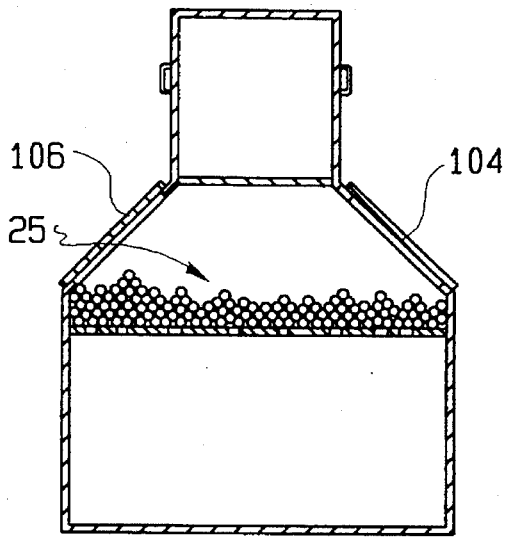
FIG. 8 illustrates another popcorn warmer having two doors for access to the bulk popcorn compartment

FIG. 8 discloses yet another embodiment of the present invention in cross-section. In this embodiment, there are two doors 104, 106 which provide access into the bulk food compartment 25 on opposing sides of the food warmer. This embodiment is particularly adapted to high traffic sites, such as movie theaters. In this embodiment, a first attendant can remain on one side of the food warmer constantly filling and placing individual portions in the upper compartment, while a second attendant can remain on the other side of the food warmer refilling it with bulk food when the supply in the bulk food compartment 25 is depleted. When the bulk food compartment is completely filled, the second attendant can either serve individual portions, or she can fill portion containers. Thus the work of two attendants can be supported by a single food warmer. Alternatively, the attendant can fill one side of the unit with bulk food or the individual serving portions which the customer accesses and selects the individualized portions from the other side of the device.

Figure 9:
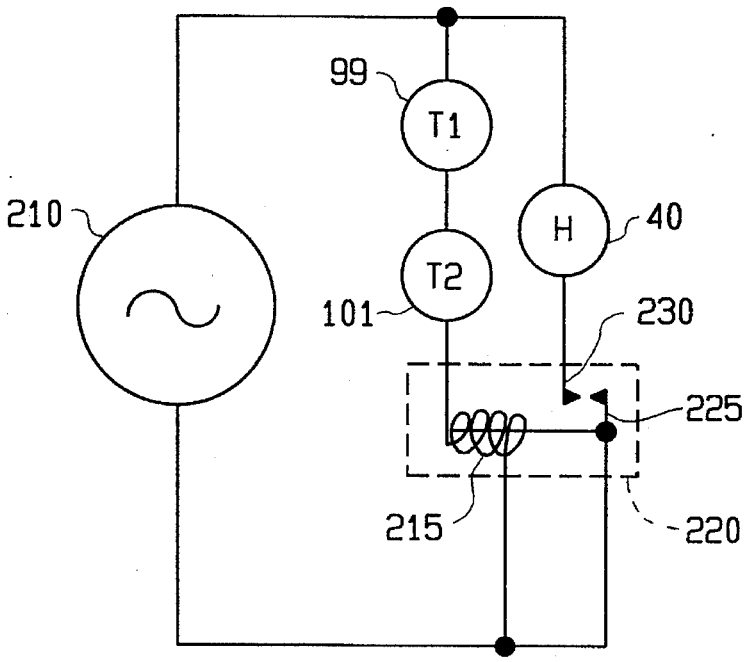
FIG. 9 illustrates an electrical circuit for controlling the food warmer heater.

FIG. 9 discloses the electrical connections between the first thermostat 99, second thermostat 101, and heater 40. This embodiment discloses a first circuit, electrically connecting power supply 210, relay coil 215, first thermostat 99 and second thermostat 101 serially in an electrical circuit. In this first circuit, a first electrical connection of power supply 210 is connected to a first electrical connection of first thermostat 99. A second electrical connection of first thermostat 99 is connected to a first electrical connection of second thermostat 101. A second electrical connection of second thermostat 101 is connected to a first electrical connection of relay coil 215. A second electrical connection of relay coil 215 is connected to a second lead of first power supply 210. The first circuit causes relay coil 215 of relay 220 to be de-energized whenever either the first or second thermostat reaches their respective cutoff temperatures.

FIG. 9 also discloses a second circuit joining power supply 210, heater 40 and contacts 225, 230 of relay 220 in serial fashion. A first electrical connection of the power supply is connected to a first electrical connection of heater 40. A second electrical connection of heater 40 is connected to first electrical contact 230 of relay 220. Second electrical contact 225 of relay 220 is connected to a second electrical connection of power supply 210 thus closing the circuit.

Since the components in the circuits described above are serially connected, any component in any of the circuits can be exchanged with any other component without changing the functioning of the circuit. Likewise, separate power supplies may be used for each circuit instead of a single supply.

In addition to the preferred embodiments disclosed above, the invention includes all modifications and embodiments which would be within the level of one skilled in the art, and it is intended that the appended claims cover all such modifications.

What is claimed is:

1. A food storage, display, and warming apparatus comprising:

a first storage compartment including a base for holding bulk food at a predetermined temperature above ambient temperature and including means for accessing the bulk food therein;

a second storage and display compartment for holding and displaying a plurality of individualized food portions and including means for viewing and accessing the individualized food portions therein;

means for heating and circulating air between the first and second storage compartments; and means for sensing the temperature of the base of the first storage compartment and for discontinuing operation of the heating and circulating means when a maximum temperature is sensed to avoid overheating the bulk food.

2. The apparatus of claim 1 wherein the heating and circulating means comprises an electric heating element, a blower for urging the air past the heating element and at least one conduit for returning heated air from the top of the second compartment to the heating element.

3. The apparatus of claim 2 further comprising a third compartment located below the first compartment for housing the heating and circulating means, wherein the at least one conduit extends from the top of the second compartment to the heating element in the third compartment.

4. The apparatus of claim 3 further comprising a partition member for supporting both the blower and heating element, with the partition being removable from the third compartment for ease in maintaining or repairing the blower or heating element.

5. The apparatus of claim 4 wherein the partition member includes a front panel which forms a portion of the exterior of the third compartment, and a first insulating member positioned between the heating element and the front panel to reduce or prevent heating of the front panel.

6. The apparatus of claim 5 wherein the blower and heating element are mounted on opposite sides of the partition member and the first insulating member comprises a non-heat-conductive or thermally insulative material.

7. The apparatus of claim 4 wherein the temperature sensing means and heating element are electrically connected by a cable, the sensing means is a thermostat which is mounted in the third compartment and the cable is of sufficient length to allow the partition to be slideably removed from the third compartment for maintenance or repair thereof without disconnecting the thermostat.

8. The apparatus of claim 7 further comprising a common wall member between the first and third compartments, the wall member being made of a heat conductive metal and wherein the thermostat is in thermal association with the wall member.

9. The apparatus of claim 8 wherein the third compartment includes a slidable drawer, and the wall member includes a perforated section positioned above the drawer for allowing heated air to pass from the third compartment to the first compartment and for removing unwanted food portions or debris from the first compartment.

10. The apparatus of claim 9 wherein the partition member includes a front panel which forms a portion of the exterior of the third compartment, and further comprising a second insulating member comprising a non-conductive or thermally insulative material positioned between the heating element and the drawer to reduce or prevent heating of the drawer.

11. The apparatus of claim 1 further comprising a separation member between the first and second compartments and having means for allowing heated air to travel from the first compartment to the second compartment while also allowing food spilled from the individualized portions to return through said separation member to the first compartment.

12. The apparatus of claim 1 wherein the second compartment has a front wall, a rear wall and two side walls, a plurality of shelves for supporting the individualized food portions, and elongated U-shaped bracket members mounted upon the side walls for engaging the sides and a portion of the top and bottom surfaces of the shelves to facilitate sliding horizontal movement of the shelves but which restricts tilting or vertical movement of the shelves, wherein the first and second compartments can be separately accessed so that escape of heated air from the compartments can be minimized.

13. The apparatus of claim 12 wherein the shelves are made of wire having openings which allow food spilled from the individualized portions to fall to the bottom of the second compartment.

14. The apparatus of claim 13 wherein the means for viewing and accessing the individualized food portions includes at least one transparent door member in the front wall of the second compartment and at least one door member in the rear wall of the second compartment so that the individual food portions can be accessed from either the front or rear of the apparatus.

15. The apparatus of claim 1 wherein the first compartment includes front and rear walls and the means for accessing the bulk food in the first compartment includes at least one door member in the front wall and at least one door member in the rear wall so that the bulk food can be accessed from either the front or rear of the apparatus.

16. The apparatus of claim 15 wherein the front and rear walls of the first compartment are sloped and each includes two doors to facilitate access to the bulk food therein.

17. The apparatus of claim 1 wherein the first compartment includes front and rear walls and further comprising a shelf member mounted on one of the front or rear walls of the first compartment.

18. The apparatus of claim 17 wherein the shelf is hingeably mounted to the first position at a location above the means for accessing the first compartment.

19. The apparatus of claim 1 which further comprises electronic components including a shut off switch and a grounded enclosure for protecting operators from electrical shock when operating the electronic components.

20. The apparatus of claim 1 wherein the sensing means is a thermostat which discontinues operation of said heating and circulating means, at a temperature of between 130° F. and 150° F.

* * * * *